US008667643B2

(12) United States Patent
Simonelli et al.

(10) Patent No.: US 8,667,643 B2
(45) Date of Patent: Mar. 11, 2014

(54) METHOD AND APPARATUS FOR ASSISTING PIVOT MOTION OF A HANDLE IN A FLOOR TREATMENT DEVICE

(75) Inventors: David J. Simonelli, Coventry, RI (US); Jason Boyd Thorne, Tai Po (HK)

(73) Assignee: Euro-Pro Operating LLC, Newton, MA (US)

( * ) Notice: Subject to any disclaimer, the term of this patent is extended or adjusted under 35 U.S.C. 154(b) by 412 days.

(21) Appl. No.: 12/879,790

(22) Filed: Sep. 10, 2010

(65) Prior Publication Data

US 2012/0060322 A1 Mar. 15, 2012

(51) Int. Cl.
*A47L 9/00* (2006.01)
*B25G 1/00* (2006.01)

(52) U.S. Cl.
USPC ..... 15/411; 15/351; 15/143.1

(58) Field of Classification Search
USPC ..... 15/411, 143.1, 410, 144.1, 329, 350, 15/351
See application file for complete search history.

(56) References Cited

U.S. PATENT DOCUMENTS

| | | | | |
|---|---|---|---|---|
| 5,323,510 | A | 6/1994 | Redding et al. | |
| 5,584,095 | A | 12/1996 | Redding et al. | |
| 5,876,141 | A | 3/1999 | Hsu | |
| 6,055,703 | A | 5/2000 | Redding et al. | |
| 6,125,502 | A | 10/2000 | Hammeken et al. | |
| 6,345,408 | B1 * | 2/2002 | Nagai et al. | 15/361 |
| 6,519,810 | B2 | 2/2003 | Kim | |
| 6,532,622 | B2 | 3/2003 | Seon et al. | |
| 6,553,613 | B2 * | 4/2003 | Onishi et al. | 15/351 |
| 7,383,608 | B2 * | 6/2008 | Odachi et al. | 15/410 |
| 7,467,439 | B2 | 12/2008 | Lijzenga et al. | |
| 7,481,630 | B2 | 1/2009 | Liffers et al. | |
| 7,503,098 | B2 | 3/2009 | Stein | |
| 7,540,057 | B2 | 6/2009 | Lin et al. | |
| 7,607,196 | B2 | 10/2009 | Li | |
| 7,854,039 | B2 | 12/2010 | Lee et al. | |
| 7,950,102 | B2 | 5/2011 | Lee et al. | |
| 8,082,624 | B2 * | 12/2011 | Myers | 15/411 |
| 8,151,408 | B2 | 4/2012 | Finke et al. | |
| 8,181,309 | B2 | 5/2012 | Mersmann et al. | |
| 8,201,302 | B2 | 6/2012 | Poetting | |
| 2002/0042969 | A1 | 4/2002 | Nagai et al. | |
| 2004/0034955 | A1 | 2/2004 | Townsend | |
| 2005/0086764 | A1 | 4/2005 | Lim et al. | |
| 2005/0223516 | A1 | 10/2005 | Courtney | |
| 2006/0207054 | A1 | 9/2006 | Loebig | |
| 2007/0245509 | A1 | 10/2007 | Nesler | |
| 2009/0056057 | A1 | 3/2009 | Poetting | |
| 2009/0056058 | A1 | 3/2009 | Finke et al. | |

(Continued)

*Primary Examiner* — Dung Van Nguyen
(74) *Attorney, Agent, or Firm* — Wolf, Greenfield & Sacks, P.C.

(57) ABSTRACT

A method and apparatus for influencing movement of a handle of a floor treatment device, such as a vacuum. The floor treatment device may include a handle portion that is attached to a base, which includes a floor treatment portion. The handle portion may be pivotally movable about a rotation axis relative to the base between at least first and second positions, where the rotation axis lies in a vertical plane that includes a longitudinal axis of the handle when the handle portion is in the first position and the longitudinal axis is a non-vertical position. A pivot assist device may apply a bias to the handle portion that urges the handle portion to move from the second position to the first position, e.g., to help support the weight of the handle when a user steers the floor treatment device across a floor.

36 Claims, 9 Drawing Sheets

(56) References Cited

U.S. PATENT DOCUMENTS

| | | | | |
|---|---|---|---|---|
| 2009/0056059 | A1 | 3/2009 | Mersmann et al. | |
| 2009/0056063 | A1 | 3/2009 | Poetting | |
| 2009/0056064 | A1 | 3/2009 | Finke et al. | |
| 2009/0056065 | A1* | 3/2009 | Finke | 15/354 |
| 2009/0089969 | A1 | 4/2009 | Lee et al. | |
| 2009/0165242 | A1 | 7/2009 | Lee et al. | |
| 2011/0023256 | A1 | 2/2011 | Conrad | |
| 2011/0219581 | A1 | 9/2011 | Vines et al. | |

* cited by examiner

METHOD AND APPARATUS FOR ASSISTING PIVOT MOTION OF A HANDLE IN A FLOOR TREATMENT DEVICE

BACKGROUND

Floor treatment devices, such as floor sweepers, vacuums, steam cleaners, mops, tools for applying floor wax or other materials, etc., commonly have a handle attached to a floor treatment portion, such as a cleaning head. The handle and cleaning head of such devices are commonly arranged so that the user can manipulate the cleaning head on the floor without requiring the user to stoop or bend at the waist. It is also common for the handle of such devices to be capable of pivoting, e.g., so that a floor contacting surface of the cleaning head can remain in contact with the floor as the user pushes and pulls on the handle to move the cleaning head across the floor. For example, U.S. Patent Publication 2009/0089969 shows an upright vacuum cleaner that has a cleaner body 10 with a handle 11 that is pivotable relative to a suction port assembly 40. As shown in FIG. 4 of U.S. Patent Publication 2009/0089969, the cleaner body 10 and handle 11 appear to be pivotable in forward-and-back directions as well as side-to-side directions relative to the suction port assembly 40.

SUMMARY OF INVENTION

Aspects of the invention provide for a floor treatment device having a handle attached to a floor treatment portion such that the handle is pivotable relative to the floor treatment portion, e.g., in side-to-side directions. Also included is a pivot assist device that urges the handle to move from one pivot position to another pivot position. For example, in one embodiment, if the handle is pivoted from a center position to a side position, e.g., to steer the floor treatment portion left or right, the pivot assist device may exert a force on the handle that tends to return the handle from the side position back to the center position. This feature may make handling of the floor treatment device easier for the user, e.g., if the handle includes a relatively heavy dirt container and fan unit on the handle, the pivot assist device may help support the weight of the handle when pivoting the handle to the side. That is, in some cases, when a user pivots a handle and attached dirt container and fan to the side, the weight of the handle and attached components may make returning the handle to its center, upright position difficult. The repeated lifting of the weight of the handle, dirt container, fan, etc., from side pivoted positions back to the center, upright position can be tiresome to a user. However, the pivot assist device in some embodiments can reduce the effective weight of the handle to the user because of the force the pivot assist device exerts on the handle to help the user lift the handle from a side pivoted position to a center position.

According to one embodiment, a floor treatment device includes a base having a floor treatment portion arranged to treat a floor and a handle portion having a proximal end, a distal end and a longitudinal axis extending generally in a direction between the proximal end and the distal end. The proximal end includes a gripping portion arranged to be gripped by a human hand, the distal end being attached to the base, and at least a part of the handle portion including the gripping portion being pivotally movable about a rotation axis relative to the base between at least first and second positions. The longitudinal axis is non-vertical when the handle portion is in the first position, and the rotation axis lies in a vertical plane that includes the longitudinal axis when the handle portion is in the first position. The floor treatment device also includes a pivot assist device that is out of contact with a floor or other surface apart from the floor treatment device, and the pivot assist device is arranged to apply a bias to the handle portion that urges the part of the handle portion to move from the second position to the first position.

According to another embodiment, a floor treatment device includes a handle portion having a proximal end, a distal end and a longitudinal axis extending generally in a direction between the proximal end and the distal end, the proximal end including a gripping portion arranged to be gripped by a human hand. The device also includes a base having a floor treatment portion arranged to treat a floor, the base being coupled to the distal end of the handle portion such that the handle portion is pivotable about a rotation axis relative to the base between at least first and second positions. The longitudinal axis is non-vertical when the handle portion is in the first position, and the rotation axis lies in a vertical plane that includes the longitudinal axis when the handle portion is in the first position. The device also includes a pivot assist device connected between the handle portion and the base, with the pivot assist device being arranged to apply a bias to the handle portion that urges the handle portion to move from the second position to the first position.

According to a further embodiment, a floor treatment device includes a handle portion having a proximal end, a distal end and a longitudinal axis extending generally in a direction between the proximal end and the distal end, the proximal end including a gripping portion arranged to be gripped by a human hand, and the distal end having a first coupling, the handle portion including a dirt canister and a fan that moves air through the dirt canister. The device includes a base having a floor treatment portion that is fluidly coupled to the dirt canister and the fan to apply suction created by the fan to a floor, with the base having a second coupling engaged with the first coupling such that the handle portion is pivotable about a rotation axis relative to the base between at least first and second positions. The rotation axis has a vertical component and lies in a vertical plane that includes the longitudinal axis when the handle portion is in the first position. The floor treatment device also has a pivot assist device including a cam attached to the first or second coupling, and a cam follower attached to the other of the first or second coupling. The cam follower engages with the cam so as to apply a bias to the handle portion that urges the handle portion to move from the second position to the first position.

According to yet another embodiment, a method for operating a floor treatment device includes providing a floor treatment device including a handle portion and a base coupled to the handle portion such that the handle portion is pivotable about a rotation axis relative to the base between at least first and second positions, the base having a floor treatment portion arranged to treat a floor and the handle portion having a longitudinal axis. The method includes rotating the handle portion about the rotation axis relative to the base from a first position, in which the longitudinal axis of the handle portion is not vertical, to a second position, the rotation axis lying in a vertical plane that includes the longitudinal axis when the handle portion is in the first position. The method further includes applying a bias from the base to the handle portion that urges the handle portion to move from the second position to the first position.

According to another embodiment, a floor treatment device is provided which includes a base having a floor treatment portion arranged to treat a floor. The device includes a handle portion having a proximal end, a distal end and a longitudinal axis extending generally in a direction between the proximal end and the distal end, the proximal end including a gripping portion arranged to be gripped by a human hand, the distal end being attached to the base, at least a part of the handle portion including the gripping portion being pivotally movable in a first rotation direction about a rotation axis relative to the base from a first rotational position to a second rotational position. The handle portion including the gripping portion is pivotally movable in a second rotation direction about the rotation axis relative to the base from the first rotational position to a third rotational position, with the second rotation direction being opposite to the first rotation direction. Also included in the floor treatment device is a pivot assist device that is out of contact with a floor or other surface apart from the floor treatment device, the pivot assist device being arranged to apply a bias to the handle portion that urges the part of the handle portion to move from the second position to the first position, and the pivot assist device being arranged to apply a bias to the handle portion that urges the part of the handle portion to move from the third position to the first position.

According to yet another embodiment, a floor treatment device includes a handle portion having a proximal end, a distal end and a longitudinal axis extending generally in a direction between the proximal end and the distal end, the proximal end including a gripping portion arranged to be gripped by a human hand. A base of the floor treatment device has a floor treatment portion arranged to treat a floor, the base being coupled to the distal end of the handle portion such that the handle portion is pivotable in a first rotation direction about a rotation axis relative to the base between at least a first position and a second position. The handle portion including the gripping portion is pivotally movable in a second rotation direction about the rotation axis relative to the base from the first rotational position to a third rotational position, with the second rotation direction being opposite to the first rotation direction. The device includes a pivot assist device connected between the handle portion and the base, the pivot assist device being arranged to apply a bias to the handle portion that urges the handle portion to move from the second position to the first position. The pivot assist device is arranged to apply a bias to the handle portion that urges the handle portion to move from the third position to the first position.

BRIEF DESCRIPTION OF THE DRAWINGS

The accompanying drawings are not intended to be drawn to scale. For purposes of clarity, not every component may be labeled in every drawing. In the drawings.

DETAILED DESCRIPTION

It should be understood that aspects of the invention are described herein with reference to the figures, which show illustrative embodiments in accordance with aspects of the invention. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Embodiments of the invention provided herein are directed to cleaning appliance systems which are capable of cleaning floors and/or other surfaces. Examples of surface cleaners include steam mops, portable steam cleaners, vacuum cleaners, floor sweepers, mops or other floor wiping devices, among others. In one aspect of the invention, a floor treatment device includes a handle attached to a base such that if the handle is rotated from a first position to a second position, a pivot assist device will exert a force on the handle to return the handle from the second position to the first position. The force exerted on the handle may be sufficient to move the handle from the second to the first position without help from the user, e.g., the handle may return to the first position if the user lets go of the handle at the second position. In other embodiments, the force exerted on the handle may not be sufficient to return the handle to the first position without the user moving the handle. For example, the pivot assist device may exert a force on the handle to maintain the handle in the second position if the user lets go of the handle.

The pivot assist device may operate to exert a force on the handle in response to rotation of the handle about one, two or more rotation axes. For example, a handle may be arranged to move pivotally about two or more rotation axes relative to the floor treatment portion, e.g., in forward and back directions as well as in side-to-side directions. The pivot assist device may be arranged to exert a force on the handle when the handle is moved in the front to back direction, the side-to-side direction, or when the handle is moved in either direction. The pivot assist device may exert a force on the handle to return it to a home position, such as an upright position in which the handle is centered relative to the floor treatment portion or other suitable positions. As discussed above, the pivot assist device may act to counteract the force of gravity on portions of the handle, making movement of the handle seem easier to the user.

Figure 1:
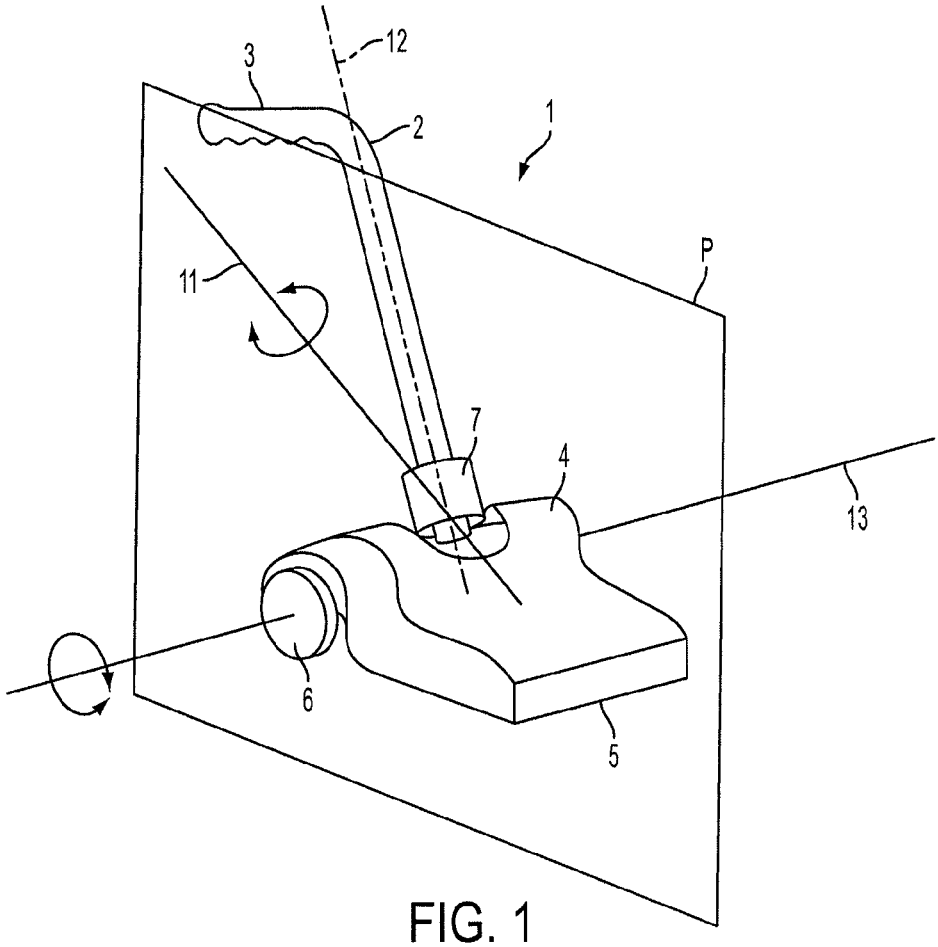
FIG. 1 is a perspective view of a floor treatment device in an illustrative embodiment.

FIG. 1 shows a perspective view of a floor treatment device 1 in an illustrative embodiment. In this illustrative embodiment, the floor treatment device 1 includes a handle 2 with a gripping portion 3 at a proximal end arranged for gripping by a user, e.g., in one hand. Although in this illustrative embodiment the handle 2 is made as a single integral part, the handle 2 may include two or more parts that are separable from each other. For example, the handle 2 may have the gripping portion 3 be separable from other portions of the handle 2, e.g., to allow for a change of gripping portions 3 or other functions. The handle 2 may also include other features not shown in FIG. 1, such as a dirt canister, a fan (including a motor to drive the fan) to move air for vacuuming or other floor treatment, one or more flexible hoses (e.g., for vacuuming by using the hose), an electrical cord, one or more interchangeable attachments (such as brushes, mop heads, vacuuming tools, etc.), and so on. Thus, the handle 2 is not limited to providing only a gripping surface for the user.

A distal end of the handle 2 is attached to a base 4 that includes a floor treatment portion 5. The floor treatment portion 5 may include any suitable arrangement for treating a floor, such as a suction opening located at a bottom side of the base 4 arranged for vacuuming a floor or other surface, one or more brushes (e.g., to loosen dirt or other debris when vacuuming, to apply cleaning solvents or other materials, to remove hair or other similar material from a rug or other surface, and so on), a mop head and/or mop holder (including removable floor wiping pads, a mop arrangement with a hands-free mop head wringing function, a steam pad, and others), a steam or other fluid ejection point (such as one or more nozzles or other openings to direct steam or other fluid onto a floor or other surface), and others. In short, the floor treatment portion 5 is not limited in the functions it may perform with respect to treating a floor or other surface, such as vacuuming, wiping (e.g., for applying polish, cleaner, wax or other material), applying steam, brushing, absorbing liquids, and so on. Further, the floor treatment portion 5 may include two or more treatment devices, such as a fluid ejection nozzle for dispensing a cleaning solution and suction head for removing dirt and cleaning solution from the floor.

The base 4 may include other suitable components, such as wheels 6 (e.g., to aid in moving the base 4 across a floor), a light (e.g., for illuminating dark areas being cleaned or otherwise treated), a dirt compartment (e.g., for holding dirt and other debris removed from a surface), a fan (including a motor) or other device for applying suction to the floor, a cleaning fluid reservoir, conduits for transporting steam or other fluids to/from the treatment portion 5, a drive motor for powering the wheels 6 or other arrangement to help propel the base 4 across a floor, and others.

Figure 2:
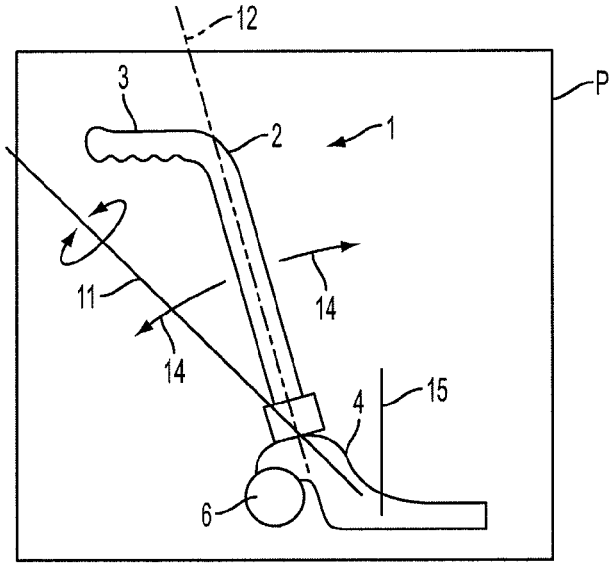
FIG. 2 is a side view of the floor treatment device of FIG. 1.
Figure 3:
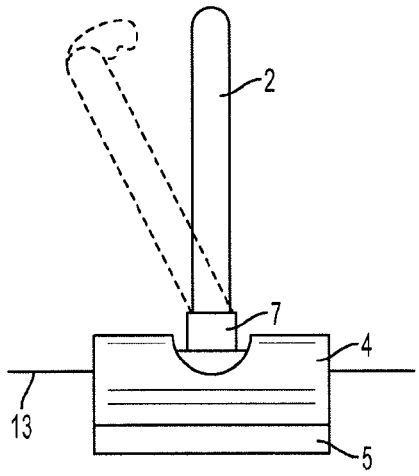
FIG. 3 is a front view of the floor treatment device of FIG. 1 and illustrates in dashed line a position of the handle when pivoted to a side position relative to a center position.

In this illustrative embodiment, the distal end of the handle 2 is attached to the base 4 such that the part of the handle 2 including the gripping portion 3 is rotatable about a rotation axis 11 that is transverse to a longitudinal axis 12 of the handle 2. (The longitudinal axis 12 of the handle extends generally from the proximal end of the handle 2 to the distal end.) Although in this embodiment the rotation axis 11 is transverse to the longitudinal axis 12, the axes 11 and 12 may be parallel or collinear if desired. In this embodiment, the rotation axis 11 lies in a vertical plane P that also includes the longitudinal axis 12 when the handle 2 is in a first position shown in FIG. 1. Although the first position could be arranged in any suitable way, in this embodiment, the first position is one in which the handle 2 is generally centered relative to the base 4 in a side-to-side direction and the longitudinal axis 12 is not vertical. For example, FIG. 2 shows a side view of the floor treatment device 1 and illustrates that when the handle 2 is in the first position, the longitudinal axis 12 and the rotation axis 11 lie in a same vertical plane P (that in this view lies in the plane of the drawing paper). FIG. 3 shows a front view of the floor treatment device 1 with a solid line view of the handle 2 depicting the handle 2 in the first position. (In the view of FIG. 3, the plane P is perpendicular to the drawing and passes through the handle 2 when in the first position.) In some embodiments, the rotation axis includes both a vertical component and a horizontal component, such as the rotation axis 11 shown in FIG. 1. A rotation axis having only a vertical component or only a horizontal component may be provided in some embodiments.

Providing the ability to rotate the handle 2 about the rotation axis 11 may be useful when steering the base 4 of the floor treatment device 1 across a floor. For example, by rotating the handle 2 about the axis 11 in a counterclockwise direction (as viewed from the rear of the gripping portion 3), the base 4 can be steered to the left. Similarly, by rotating the handle 2 about the axis 11 in a clockwise direction, the base 4 can be steered to the right. This feature can make maneuvering the device 1 across a floor easier. For example, in some embodiments, rotating the handle 2 about the axis 11 by twisting the handle causes pivoting of the base 4 about a vertical rotation axis 15 to facilitate steering the device 1. The handle 2 may remain at a constant angle relative to the floor and pivot around its own axis, but relative to base 4, the handle pivots around axis 11. Further, by arranging the pivot assist device 7 to help return the handle 2 to a centered position (e.g., in which the base 4 can be propelled in a straight direction), the user may only release or reduce a twisting force on the handle 2 to have the base 4 return to moving in a straight direction.

In this illustrative embodiment, the handle 2 is also pivotable relative to the base 4 about another rotation axis 13 that is generally perpendicular to the longitudinal axis 12, e.g., so that the handle 2 can be moved in up and down directions relative to the base 4. As shown in FIG. 2 the up and down directions in this embodiment correspond to movement of the handle 2 in the directions of the arrows 14. (The longitudinal axis 12 of the handle 2 in this embodiment will remain in the plane P with movement in the up and down direction as long as the handle is not rotated about the rotation axis 11.)

In accordance with an aspect of the invention, a pivot assist device 7 is provided to exert a force on the handle 2 when the handle 2 is rotated from the first position about the rotation axis 11. For example, if the handle 2 is pivoted about the rotation axis 11 to a second position shown in dashed line in FIG. 3, the pivot assist device 7 will exert a force on the handle 2 that urges the handle 2 to return to first position. The force exerted on the handle 2 by the pivot assist device 7 need not necessarily be sufficient to return the handle 2 to the first position (e.g., sufficient to overcome the force of gravity on the handle 2) if a user lets go of the handle 2, but instead may maintain the handle 2 in the second position if the user lets go of the gripping portion 3. In another embodiment, the force exerted by the pivot assist device 7 need not necessarily be sufficient to maintain the handle 2 at the second position when the handle 2 is released by a user, but instead may permit the handle 2 to rotate further to the side if the user lets go of the handle 2. Also, the pivot assist device 7 is not limited to assisting in moving the handle 2 from a second position to the first position, but instead may provide an assisting force for handle rotation when moving from the first position to the second position as well. For example, the pivot assist device 7 may sense a twisting force exerted by the user to the handle 2 and in response provide a suitable force to the handle 2 to held the user rotate the handle 2 as indicated by the user's force on the handle 2. Further details regarding such operation are described below, e.g., in connection with FIG. 16.

Although FIG. 3 shows pivotal movement of the handle 2 to only one side (i.e., the left side position shown in dashed line in FIG. 3), the handle 2 in the FIG. 1 embodiment may be movable to both sides of the first position. That is, when viewing the direction of rotation of the handle 2 about the rotation axis 11 from behind the gripping portion 3, the handle may be rotated in a clockwise direction about the rotation axis 11 (e.g., to the dashed line position shown in FIG. 3), and in response, the pivot assist device 7 may exert a force in the counterclockwise direction on the handle 2. Also, the handle 2 may be rotated in a counterclockwise direction about the rotation axis 11 (e.g., to a third position on the right side of the first position as shown in FIG. 3), and in response, the pivot assist device 7 may exert a clockwise force on the handle 2 that urges the handle 2 to return to the first position. Thus, the first position in some embodiments may be a home position, e.g., a position to which the pivot assist device 7 applies forces to the return the handle 2.

Although in this embodiment, the pivot assist device 7 is shown located relatively near the base 4, the pivot assist device 7 may be positioned in any suitable location. For example, the pivot assist device 7 may be located further up the handle 2 and the base 4 may include a portion that extends further from the base 4 than that shown in FIG. 1. In some embodiments, the pivot assist device 7 is located at a coupling between the handle 2 and the base 4, e.g., a coupling that permits rotary or other movement of the handle relative to the base. However, the pivot assist device 7 need not necessarily be located at the handle/base coupling, but instead may be located remote from the coupling. For example, the pivot assist device 7 may include springs or other elastic elements that connect one or more portions of the base 4 to one or more portions of the handle 2, e.g., in a way similar to how guy wires attach between portions of a tower and portions of the ground.

The coupling, or connection, between the handle 2 and the base 4 may be arranged in any suitable way. For example, in one embodiment, the handle 2 may include a first coupling and the base 4 may include a second coupling. Both couplings may be arranged as tubular members, and one of the couplings (such as the first coupling) may have an inner diameter arranged to receive the second coupling. This tube-within-a-tube coupling may permit relative rotation of the first and second couplings, e.g., to provide rotational motion of the handle 2 relative to the base 4. Other coupling arrangements are possible, however. For example, the handle 2 and base 4 may be joined by a flexible tube, rod, spring or other element that permits rotation of the handle 2 relative to the base 4. In such an embodiment, the flexible tube, rod, spring or other element may also function as the pivot assist device 7, e.g., exerting a force on the handle 2 to return to a home position when the handle 2 is moved away from the home position.

Although in this embodiment the pivot assist device 7 does not exert a force on the handle 2 in response to rotation of the handle 2 about the axis 13, the pivot assist device 7 could provide a force on the handle 2 to urge the handle 2 to move about the axis 13 as well, e.g., to return the handle 2 to a fully upright position in which the handle 2 contacts a stop on the base 4. Thus, if a user pushed the handle 2 down, e.g., from the position shown in FIG. 2, the pivot assist device 7 could apply a force to the handle 2 that urges the handle 2 to return to the position shown in FIG. 2.

Figure 4:
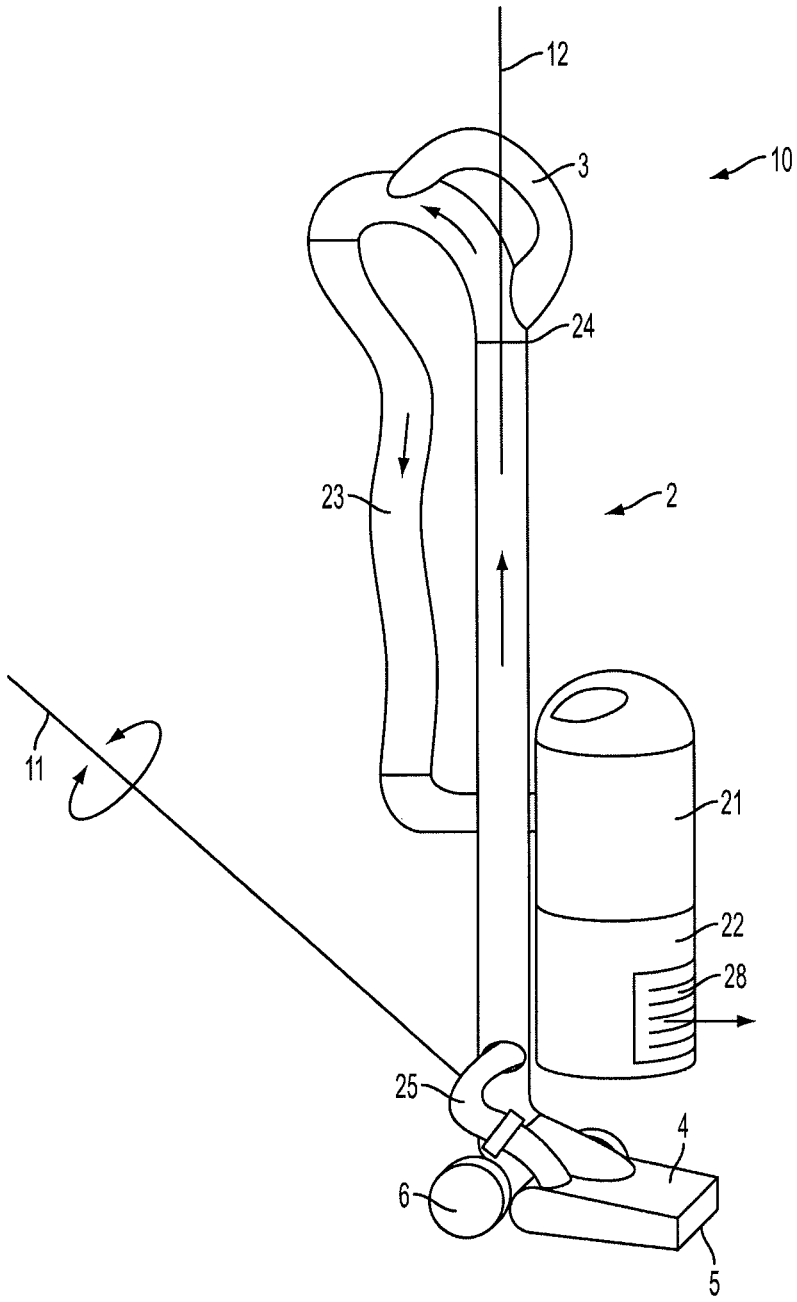
FIG. 4 is a right side perspective view of a vacuum in an illustrative embodiment.
Figure 5:
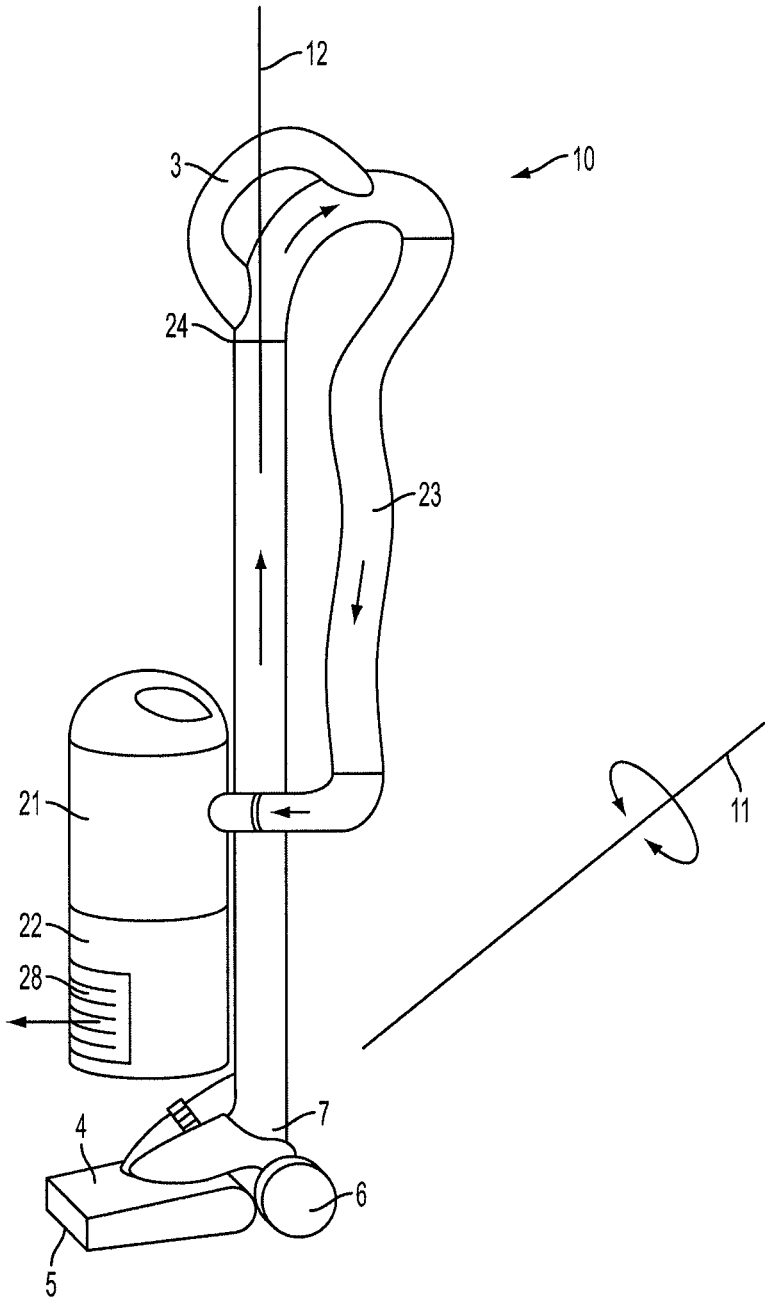
FIG. 5 is a left side perspective view of the vacuum of FIG. 4.

FIGS. 4 and 5 show right and left side perspective views of an illustrative vacuum cleaner that incorporates one or more aspects of the invention. Similar to the FIG. 1 embodiment, the vacuum 10 includes a base 4 with wheels 6 and a floor treatment portion 5 (e.g., including a suction opening and rotating brush for vacuuming floors and other surfaces). Of course, the base 4 could include other functional components to provide other floor treatments as desired. The handle 2 includes a gripping portion 3 as well as a dirt container 21, fan 22 (including a motor to drive an air moving element), and a flexible hose 23. Again, it is to be understood that this is only one illustrative embodiment, and a vacuum or other floor treatment device in accordance with aspects of the invention need not have any or all of the components shown in FIGS. 4 and 5. The fan 22 is fluidly coupled to the dirt canister 21 and other components so that air (and dirt or other debris) entering the suction port at the floor treatment portion 5 travels through a connector 25, up through a main body of the handle 2 (in the direction shown by the arrows), through a part of the gripping portion 3, down through the flexible hose 23 and into the dirt canister 21. As is well understood, the dirt canister 21 may capture dust and other debris in the air flow, allowing relatively clean air to pass through the fan 22 and exit from a grille 28. In this embodiment, the gripping portion 3 may be selectively removed from the main body of the handle 2 at a junction 24, e.g., so that the gripping portion 3 may be used to vacuum upholstery, stairs or other surfaces.

A pivot assist device 7 is arranged at a connection between the handle 2 and the base 4, and like the FIG. 1 embodiment, is arranged to exert a force on the handle 2 to urge the handle 2 to rotate to a central first position when the handle 2 is rotated about a rotation axis 11. Since in this embodiment the handle 2 includes the dirt canister 21 and fan 22, the handle 2 may be relatively heavy, or at least heavier than without the dirt canister 21 and fan 22. Also, with the dirt canister 21 and fan 22 mounted on the forward side of the handle 2, when the handle 2 is rotated about the axis 11, the weight of the dirt canister 21 and fan 22 will tend to further rotate the handle 2. That is, when the handle 2 is at a first, central position, the weight of the dirt canister 21 and the fan 22 will be centered over the longitudinal axis 12 of the handle 2 and over the connection between the handle 2 and the base 4. However, when the handle 2 is rotated about the rotation axis 11, the dirt canister 21 and fan 22 will be offset to one side of the longitudinal axis 12 and the connection to the base. As a result, the force of gravity will pull on the dirt canister 21 and fan 22 so as to apply a moment to the handle 2 that urges the handle 2 to further rotate about the axis 11. This added moment can be a stress to the user, since the user would otherwise need to support the weight of the dirt canister 21 and the fan 22 in the rotated position against the force of gravity. However, the pivot assist device 7 may counteract the moment caused by rotating the dirt canister 21 and fan 22 to one side or the other of a central position, easing a twisting force needed to be exerted by a user at the gripping portion 3 to maintain the handle 2 in a desired position.

Figure 6:
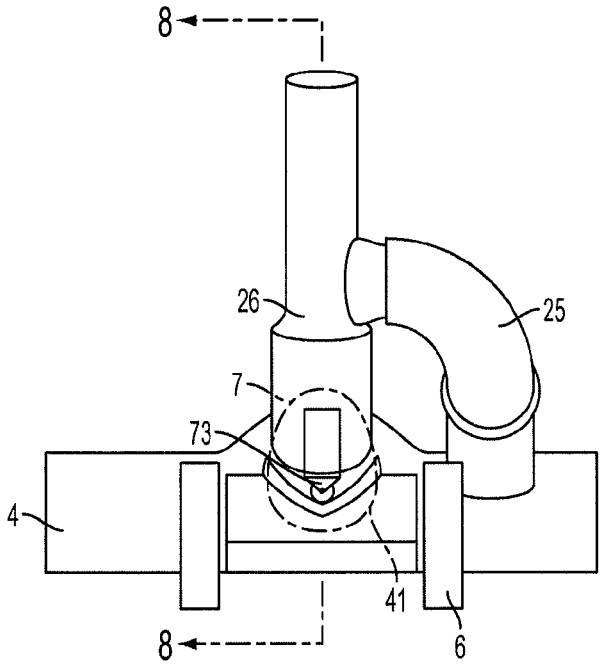
FIG. 6 is a rear view of the floor treatment portion of the vacuum of FIG. 4.

FIG. 6 shows a rear view of the base 4 and lower portion of the handle 2 of the vacuum 10 of FIGS. 4 and 5. In this embodiment, upper portions of the handle 2, including the dirt canister 21, fan 22, gripping portion 3, flexible hose 23, etc., are separable from a lower portion of the handle 2 that includes a first coupling 26. The first coupling 26 has a tubular arrangement and mates with the connector 25 to fluidly connect the floor treatment portion 5 with the main body of the handle 2. The first coupling 26 mates with a second coupling 41 of the base 4 that is pivotally mounted to the frame of the base 4. Although discussed in more detail below, the attachment of the second coupling 41 to the frame of the base 4 provides for the pivotal movement of the handle 2 about the rotational axis 13. Also shown is the pivot assist device 7, which is connected between the base 4 and the handle 2. In this embodiment, the pivot assist device has a first portion attached to the first coupling 26 and a second portion attached to the second coupling 41.

Figure 7:
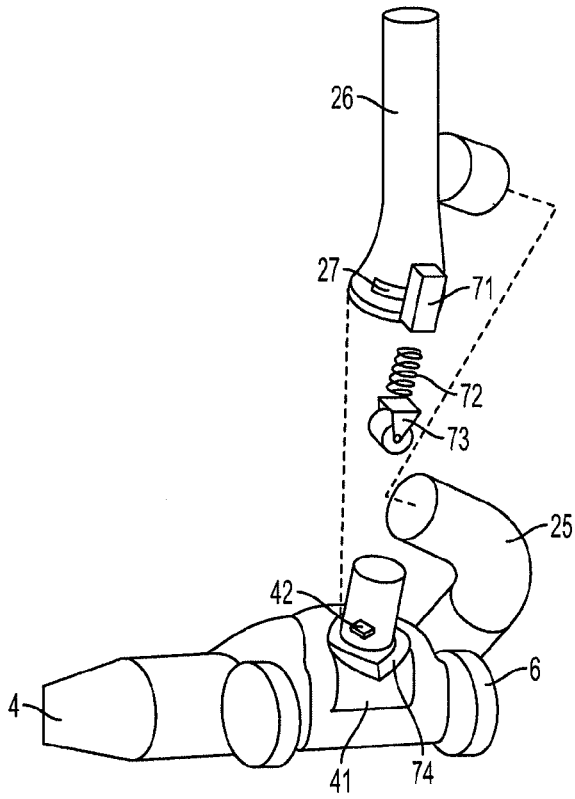
FIG. 7 is a rear perspective exploded view of the floor treatment portion of the vacuum of FIG. 4.

FIG. 7 shows an exploded rear perspective view of the base 4 and lower portion of the handle 2 of FIG. 6. The lower end of the first coupling 26 is arranged to receive the upper end of the second coupling 41, e.g., so that the first coupling 26 is rotatable relative to the second coupling 41. In this embodiment, the first coupling 26 has a slot 27 that engages with a tab 42 that maintains axial engagement between the first and second couplings while allowing for relative rotation. However, it should be understood that the first and second couplings may be engaged in any suitable way, such as by a ball and socket joint, a locking sleeve or collar, and so on. The pivot assist device 7 in this embodiment includes a channel 71 that is fixed to the first coupling 26. The channel 71 has a passageway with an opening at the lower end of the channel 71 that receives a spring 72 and a cam follower 73. The cam follower 73 in this arrangement includes a wheel that is pivotally mounted to a carrier that is slidably received in the passageway of the channel 71. The pivot assist device 7 also includes a cam 74, that in this embodiment is formed as a V-shaped surface that is fixed to the second coupling 41.

Figure 8:
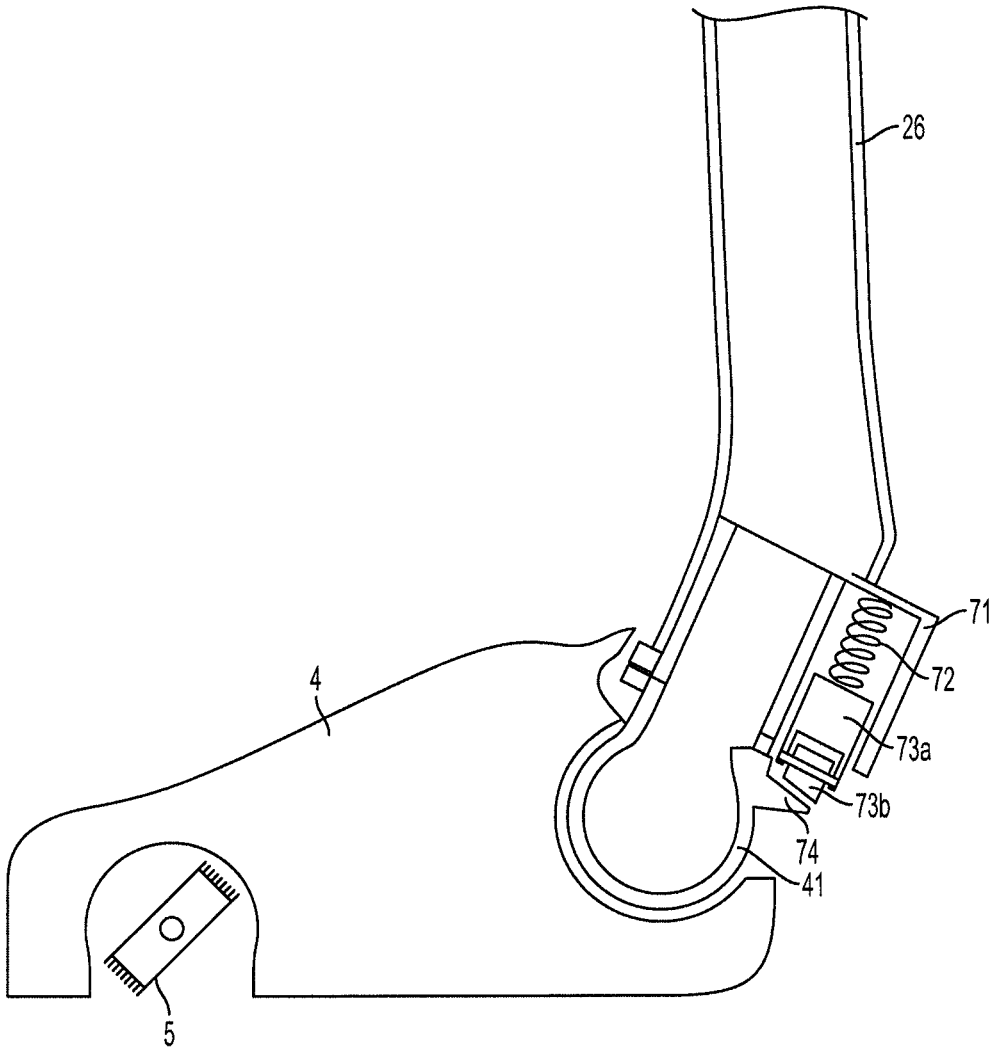
FIG. 8 is a cross sectional view along the line 8-8 in FIG. 6.

FIG. 8 shows a cross sectional view along the line 8-8 in FIG. 6. This view in FIG. 8 shows how the lower end of the first coupling 26 receives the upper end of the second coupling 41. Also, FIG. 8 shows a cylindrical outer surface of the second coupling 41 that is engaged with a corresponding cylindrical cavity in the frame of the base 4. This engagement permits the second coupling 41 to be pivoted about the rotation axis 13 relative to other portions of the base 4. This view also shows how the passageway of the channel 71 receives the spring 72 and the cam follower 73, which includes the carrier 73*a* and the wheel 73*b* that is rotatably mounted to the carrier 73*a*. The wheel 73*b* is in engagement with the cam 74 of the second coupling 41.

Figure 9:
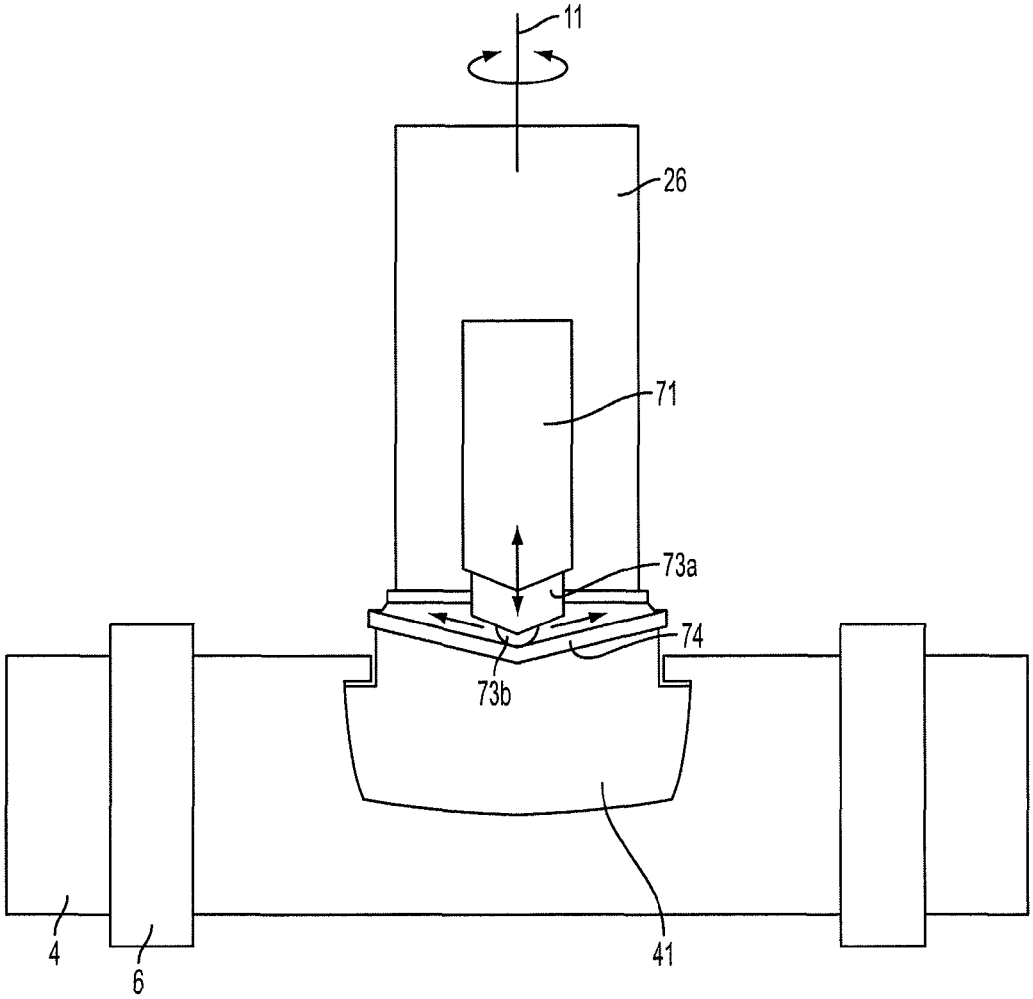
FIG. 9 is a close-up rear view of the floor treatment portion of the vacuum of FIG. 4.
Figure 10:
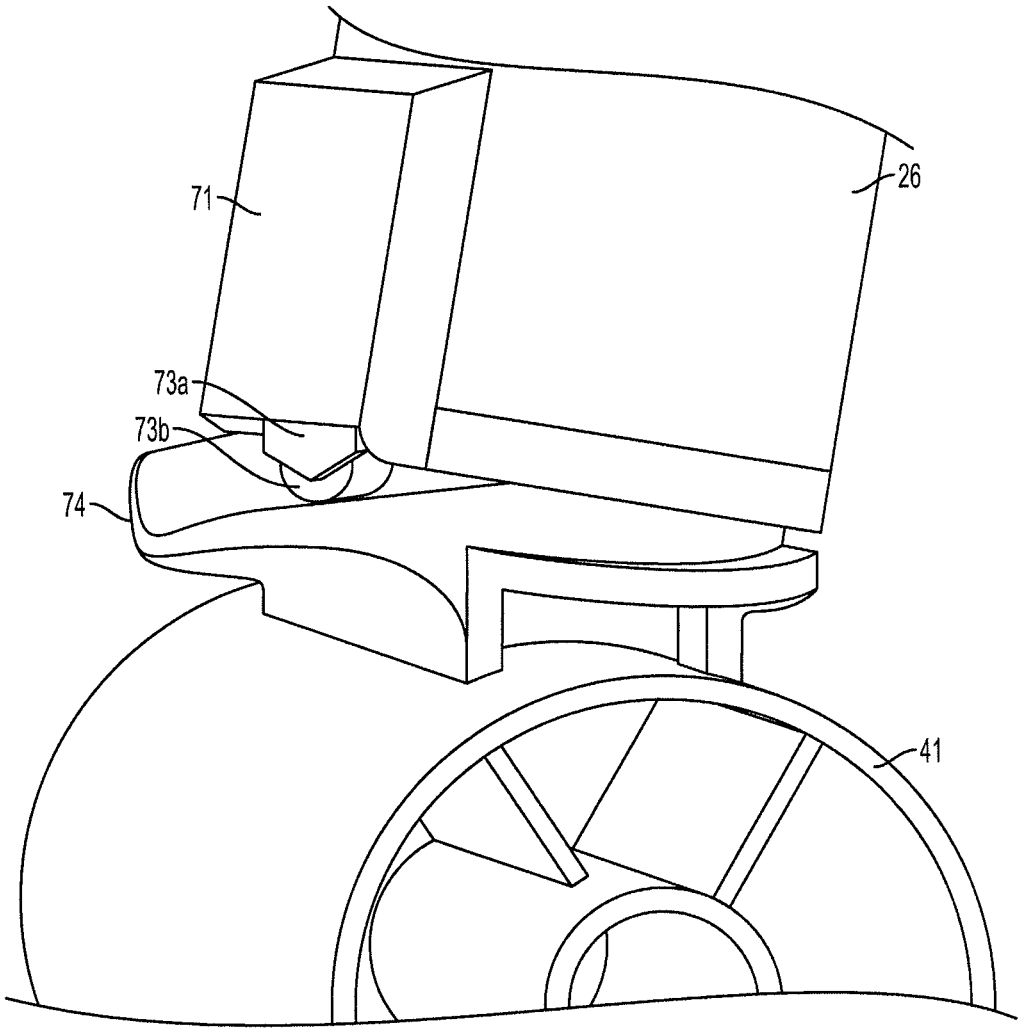
FIG. 10 is a rear perspective view of the first and second couplings and the cam and cam follower arrangement of the vacuum of FIG. 4.

FIG. 9 shows a close-up rear view of the first and second couplings 26 and 41 along with the pivot assist device 7. As the first coupling 26 is rotated about the rotation axis 11 (which in this case is parallel to a longitudinal axis of the tubular portions of the first and second couplings 26 and 41 that are engaged with each other), the channel 71 and cam follower 73 move to the left or right relative to the cam 74. Since the cam 74 has a V-shaped surface, the wheel 73*b* will ride up the cam 74 as the first coupling 26 is rotated from the position shown in FIG. 9, compressing the spring 72 (not shown in FIG. 9) and sliding the carrier 73*a* into the passageway of the channel 71. As a result of the spring 72 pressing down on the wheel 73*b* and the sloped surface of the cam 74, the cam 74 will exert a force on the wheel 73*b* (and thus the carrier 73*a*, channel 71 and first coupling 26) that urges the wheel 73*a* to move down the cam 74 toward the center of the V-surface. For example, if the first coupling 26 is rotated about the axis 11 so that the wheel 73*b* moves to the right in FIG. 9, the force of the spring 72 pressing the wheel 73*b* into contact with the cam 74 will cause the cam 74 to exert a force on the first coupling 26 to urge it to rotate so that the wheel 73*b* returns to the center position shown in FIG. 9. Similar is true for rotation of the first coupling 26 that moves the cam follower 73 to the left in FIG. 9. To give more detail regarding the interaction of the parts of the pivot assist device 7 in this illustrative embodiment, FIG. 10 shows a close-up perspective view of the pivot assist device 7. The outer cylindrical shape of the second coupling 41 at its lower end (which engages with the cylindrical cavity of the frame of the base 4) is shown somewhat more clearly in FIG. 10, at least in partial view.

Figure 17:
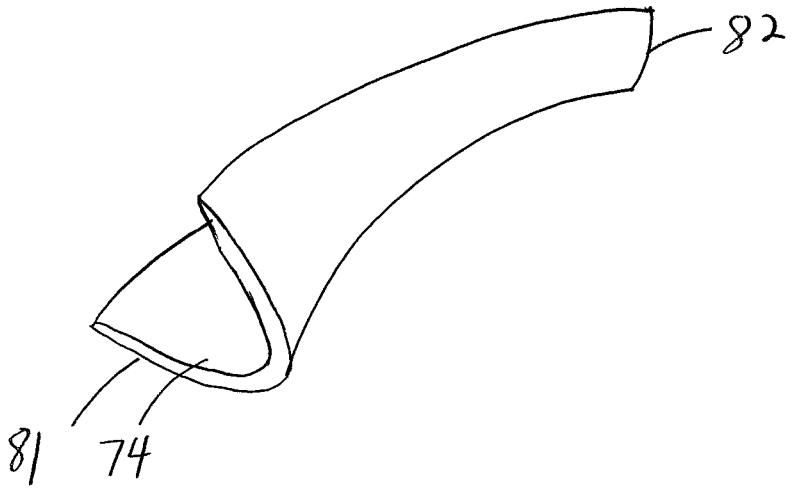
FIG. 17 shows a perspective view of an alternative embodiment of a cam surface.

Although the cam 74 is shown has having a V-shaped surface in this illustrative embodiment, the cam 74 may be arranged in any suitable way. For example, the cam 74 may have a partial elliptical shape, a circular shape, a parabolic shape, a "W" or wave-like shape (e.g., to provide a detent feature that tends to hold the handle 2 in one or more rotated positions—note that the "W" or wave shape may have an overall V-type or circular configuration so as to provide a force that tends to return the handle to a central location), an irregular shape, or any other suitable configuration. In some embodiments, as handle 2 pivots about rotational axis 13, the cam may be configured and shaped such that the slope of the cam encountered by the cam follower varies. For example, as shown in FIG. 17, cam 74 may be attached to the floor treatment portion and have a surface which has a V-type configuration from side-to-side and a convex shape from front-to-back. As the cam follower (not shown in FIG. 17) is pivoted rearwardly about rotational axis 13 toward a lower cam end 81, the associated V-type configuration may have an increased slope such that larger forces are provided to urge the cam follower toward a home position as compared to the slope of cam 74 closer to an upper cam end 82. Additionally, in some embodiments, the slope on one side of cam 74 may be different from the slope on the other side of cam 74. Such an arrangement may be used to account for a loading on the handle which applies a force in a same direction regardless of the direction of rotation of handle 2 about rotation axis 11. For example, connector 11 may be configured such that the connector applies a force to handle 2 which urges the handle in the counterclockwise direction regardless of which direction handle 2 is rotated.

Figure 11:
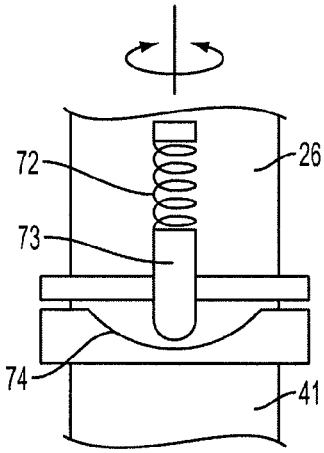
FIGS. 11-16 show different illustrative embodiments for pivot assist devices in accordance with the invention.

Also, the cam follower 73 need not include a wheel, but instead may include a projecting member like that shown in FIG. 11 that contacts the cam 74. In other embodiments, the relative positions of the cam 74 and cam follower 73 may be reversed, with the cam follower 73 mounted to the second coupling 41 and the cam 74 mounted to the first coupling 26.

Figure 12:
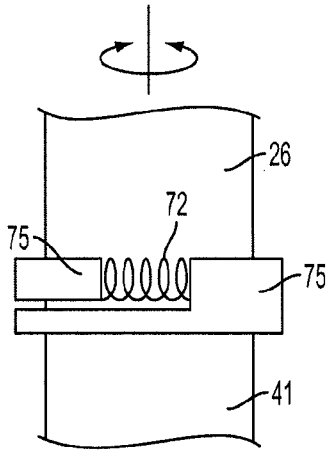

It should also be appreciated that the pivot assist device 7 may take a variety of different forms that provide a force on the handle that urges the handle to move in a rotational direction. For example, FIG. 12 shows an embodiment in which the first and second couplings 26 and 41 include confronting surfaces 75 that have a spring 72 extending between the surfaces 75. As the first coupling 26 is rotated relative to the second coupling 41, the spring 72 may compress (or extend), thus causing the spring 72 to exert a counteracting force on the first coupling 26. That is, if the first coupling 26 is rotated in a clockwise direction from a rest position, the spring 72 will exert a force on the first coupling 26 in a counterclockwise direction, and vice versa. Multiple springs 72 may be provided, e.g., around the circumference of the couplings, if desired. (Similarly, multiple cam/cam follower or other arrangements may be provided with a pivot assist device 7.)

Figure 13:
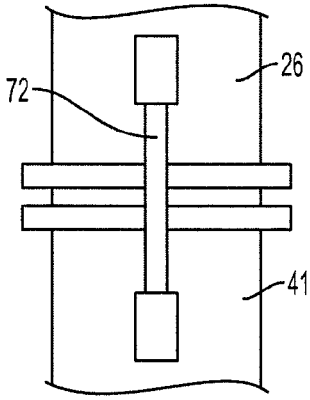

FIG. 13 shows another illustrative embodiment in which the first and second couplings 26 and 41 are joined together by a resilient element 72. The resilient element 72 may be a coil spring, a metal rod or leaf spring (e.g., made of spring steel), an elastic rubber material, or other device. Since ends of the resilient element 72 may be attached to the first and second couplings 26 and 41, as the first coupling 26 is rotated relative to the second coupling 41, the resilient element 72 may exert a restoring force on the first coupling 26 that resists the rotational movement.

Figure 14:
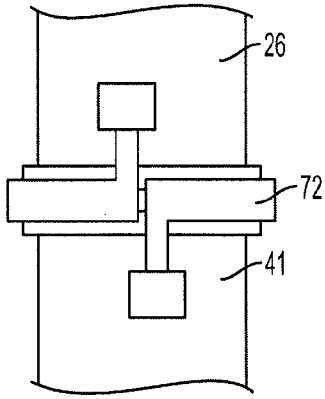
Figure 15:
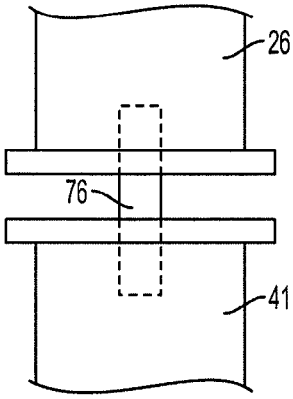

FIG. 14 shows yet another illustrative embodiment which includes a C-shaped spring 72 that extends around the periphery of the first and/or second couplings 26 and 41 and is attached at opposite ends to the couplings. As with the other embodiments discussed above, the C-shaped spring 72 may exert a force on the first coupling 26 to urge the coupling 26 to return to the position shown in FIG. 14 if the coupling 26 is rotated. FIG. 15 shows another embodiment in which the first and second couplings 26 and 41 are coupled by a torsion rod 76 that is secured at opposite ends to the first and second couplings 26 and 41. Other arrangements will occur to those of skill in the art.

Figure 16:
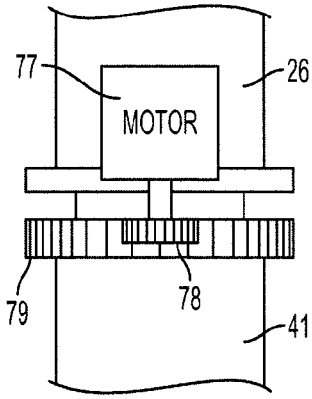

The pivot assist device 7 need not necessarily rely on the deformation of one or more resilient elements to provide a force that urges the handle 2 to move in a rotary direction. For example, FIG. 16 shows an embodiment in which the pivot assist device 7 includes a motor 77 that is mounted to the first coupling 26 and is coupled to a pinion gear 78. The pinion gear 78 engages with a rack 79 on the second coupling 41 so that as the motor 77 rotates the pinion gear 78, a force is exerted to rotate the first and second couplings 26 and 41 relative to each other. The motor 77 may be controlled, e.g., using a proportional controller, PID controller, or other controller, so that the motor 77 may exert a force on the first coupling 26 to move the first coupling 26 between two rotary positions. As mentioned above, the motor 77 need not be controlled to actually cause movement of the first coupling 26 when the coupling 26 is moved from a first position to a second position, but rather may exert a force that tends to urge the coupling 26 to return to the first position without actually causing the coupling 26 to move. In one embodiment, a controller for the motor 77 may include a force sensor in the gripping portion 3 or other part of the handle 2 that senses one or more forces exerted on the handle 2 by a user's hand. The controller may control the motor 77 to assist in handle rotation based on how the user manipulates the gripping portion 3. For example, if a user applies a twisting force to move the handle from a home position to a second position, the motor 77 may be controlled to allow for relatively easy rotation from the home position to the second position (or even may assist in such rotation). Once the user stops applying the twisting force, the motor 77 may be controlled to maintain the handle at the second position, e.g., while requiring the user to exert a relatively small or no force to the handle 2. However, once the user applies a twisting force to the handle 2 to move the handle 2 back to the home position, the motor 77 may apply a force to the handle 2 to return it to the home position.

In certain embodiments, one or more dampeners may be included in the pivot assist device and/or in pivot connections between the handle and the floor treatment portion. For example, a viscoelastic material may be added to smooth vibrations created through use of the pivot assist device.

For purposes herein, the term "floor" is meant to include various types of floors, such as hardwood floors, linoleum floors, carpets, and any other floor surface amenable to cleaning. It should be appreciated that aspects of the embodiments disclosed herein may be employed with floor treatment devices which are capable of cleaning or otherwise treating surfaces other than floors, such as countertops, walls, ceilings, oven hoods, or other surfaces.

For purposes herein, the terms "connect", "connected", "connection", "attach", "attached" and "attachment" refer to direct connections and attachments, indirect connections and attachments, and operative connections and attachments.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A floor treatment device, comprising:

a base having a floor treatment portion arranged to treat a floor;

a handle portion having a proximal end, a distal end and a longitudinal axis extending generally in a direction between the proximal end and the distal end, the proximal end including a gripping portion arranged to be gripped by a human hand, the distal end being attached to the base, at least a part of the handle portion including the gripping portion being pivotally movable about a rotation axis relative to the base between at least first and second positions, the longitudinal axis being non-vertical when the handle portion is in the first position, and the rotation axis lying in a vertical plane that includes the longitudinal axis when the handle portion is in the first position; and a pivot assist device that is out of contact with a floor or other surface apart from the floor treatment device, the pivot assist device arranged to apply a bias to the handle portion that urges the part of the handle portion to move from the second position to the first position.

2. The device of claim 1, wherein the first position is a home position for the handle portion relative to the base, and the second position is a position away from the home position.

3. The device of claim 2, wherein the pivot assist device is arranged to apply a bias to the handle portion to return the handle portion to the home position.

4. The device of claim 1, wherein the second position is in a clockwise direction relative to the first position.

5. The device of claim 4, wherein the handle portion is movable about the rotation axis to a third position that is in a counterclockwise direction relative to the first position.

6. The device of claim 5, wherein the pivot assist device is arranged to apply a bias to the handle portion in a counterclockwise direction when the handle portion is in the second position, and is arranged to apply a bias to the handle portion in a clockwise direction when the handle portion is in the third position.

7. The device of claim 6, wherein the pivot assist device applies no bias to the handle portion when the handle portion is in the first position.

8. The device of claim 1, wherein the handle portion is pivotally movable about the rotation axis through at least 30 degrees.

9. The device of claim 1, wherein the pivot assist device includes a cam and cam follower that contacts the cam.

10. The device of claim 1, wherein the distal end includes a first coupling, the base includes a second coupling engaged with the first coupling to join the distal end of the handle portion to the base and to allow pivotal movement of the handle portion relative to the base about the rotation axis, and the pivot assist device includes a first portion that engages with the first coupling, and a second portion that engages with the second coupling.

11. The device of claim 10, wherein the pivot assist device is configured such that as the first coupling is rotated relative to the second coupling, the pivot assist device exerts a counteracting force on the first coupling.

12. The device of claim 1, wherein the floor treatment device includes a vacuum, and wherein the handle portion includes a dirt canister and fan that moves air through the dirt canister.

13. The device of claim 12, wherein the dirt canister is fluidly coupled to the base to apply suction at the floor treatment portion.

14. The device of claim 1, wherein the handle portion and the base are arranged so as to rotate the base about a vertical base rotation axis when the handle portion is pivoted about the rotation axis.

15. The device of claim 1, wherein the pivot assist device applies a force in a direction which is parallel or co-linear with the rotation axis.

16. The device of claim 1, wherein the pivot assist device includes a resilient element that exerts a force that at least in part causes the bias to be applied on the handle portion.

17. The device of claim 16, wherein the resilient element includes a spring that exerts a force that at least in part causes the bias to be applied on the handle portion.

18. A device of claim 16, wherein the resilient element comprises an elastic rubber material that exerts a force that at least in part causes the bias to be applied on the handle portion.

19. A floor treatment device, comprising:

a handle portion having a proximal end, a distal end and a longitudinal axis extending generally in a direction between the proximal end and the distal end, the proximal end including a gripping portion arranged to be gripped by a human hand, and the distal end having a first coupling, the handle portion including a dirt canister and a fan that moves air through the dirt canister;

a base having a floor treatment portion that is fluidly coupled to the dirt canister and the fan to apply suction created by the fan to a floor, the base having a second coupling engaged with the first coupling such that the handle portion is pivotable about a rotation axis relative to the base between at least first and second positions, the rotation axis having a vertical component and lying in a vertical plane that includes the longitudinal axis when the handle portion is in the first position; and a pivot assist device including a cam attached to the first or second coupling and a cam follower attached to the other of the first or second coupling, the cam follower engaging with the cam so as to apply a bias to the handle portion that urges the handle portion to move from the second position to the first position.

20. The device of claim 19, wherein the second coupling is attached to the floor treatment portion such that the second coupling is pivotable about an axis transverse to the vertical plane relative to the floor treatment portion.

21. The device of claim 20, wherein pivoting of the handle portion about the rotation axis causes the base to pivot about a base rotation axis which is vertical.

22. The device of claim 19, wherein the cam follower is biased in a direction parallel to the rotation axis.

23. The device of claim 19, wherein the pivot assist device includes a resilient element that exerts a force that at least in part causes the bias to be applied on the handle portion.

24. A device of claim 23, wherein the resilient element comprises an elastic rubber material that exerts a force that at least in part causes the bias to be applied on the handle portion.

25. A device of claim 23, wherein the resilient element includes a spring that exerts a force that at least in part causes the bias to be applied on the handle portion.

26. The device of claim 25, wherein the pivot assist device is configured such that as the handle portion is pivoted about the rotation axis relative to the base from the first position to the second position, the pivot assist device exerts a counteracting force on the handle portion to urge it toward the first position.

27. The device of claim 19, wherein the pivot assist device is configured such that as the handle portion is pivoted about the rotation axis relative to the base from the first position to the second position, the pivot assist device exerts a counteracting force on the handle portion to urge it toward the first position.

28. A method for operating a floor treatment device, the floor treatment device including a handle portion and a base coupled to the handle portion such that the handle portion is pivotable about a rotation axis relative to the base between at least first and second positions, the base having a floor treatment portion arranged to treat a floor and the handle portion having a longitudinal axis, the method comprising:

rotating the handle portion about the rotation axis relative to the base from a first position, in which the longitudinal axis of the handle portion is not vertical, to a second position, the rotation axis lying in a vertical plane that includes the longitudinal axis when the handle portion is in the first position; and applying a bias from the base to the handle portion that urges the handle portion to move from the second position to the first position.

29. The method of claim 28, wherein the step of applying a bias comprises:

exerting a force from a cam follower to a cam.

30. The method of claim 29, wherein the cam includes a V-shaped surface attached to the base, and the cam follower includes a wheel attached to the handle portion that is biased into contact with the V-shaped surface.

31. The method of claim 28, wherein the step of applying a bias comprises:

exerting a force of a spring onto a portion of the handle portion.

32. The method of claim 28, wherein the step of applying a bias comprises:

exerting a force of a spring onto the base.

33. The method of claim 28, wherein as the handle portion is rotated about the rotation axis relative to the base from a first position, the step of applying a bias comprises:

exerting a counteracting force on the handle portion to urge it toward the first position when the handle.

34. The method of claim 33, wherein exerting a counteracting force on the handle portion comprises exerting a counteracting force on the handle portion with a spring.

35. The method of claim 28, wherein the step of rotating comprises:

elastically deforming a resilient element as the handle portion moves from the first position to the second position.

36. The method of claim 28, wherein the longitudinal axis extends generally from a gripping portion of the handle portion to the base.

* * * * *